United States Patent [19]

Ambasz

[11] 4,157,203

[45] Jun. 5, 1979

[54] ARTICULATED DOUBLE BACK FOR CHAIRS

[75] Inventor: Emilio Ambasz, New York, N.Y.

[73] Assignee: Center for Design Research and Development N.V., Curacao, Netherlands Antilles

[21] Appl. No.: 902,287

[22] Filed: May 1, 1978

Related U.S. Application Data

[63] Continuation-in-part of Ser. No. 795,108, May 9, 1977, abandoned.

[51] Int. Cl.[2] ..... A47C 3/00

[52] U.S. Cl. ..... 297/300; 297/285; 297/286; 297/304; 297/306; 297/354; 297/355

[58] Field of Search ..... 297/284, 295, 296–300, 297/304, 306, 354, 355, 396

[56] References Cited

U.S. PATENT DOCUMENTS

| | | | |
|---|---|---|---|
| 2,020,028 | 11/1935 | Hanauer | 297/296 |
| 2,636,552 | 4/1953 | Long | 297/396 X |
| 2,711,785 | 6/1955 | Möller | 297/297 |
| 2,801,678 | 8/1957 | Brandon | 297/396 |
| 4,007,962 | 2/1977 | Müller-Diesig | 297/355 X |

*Primary Examiner*—James C. Mitchell

[57] ABSTRACT

A back for a chair comprises at least one back-supporting frame member, a lower back mounted on the frame member for backward tilting movement about a first horizontal, transverse axis and yieldably restrained against such backward tilting and an upper back mounted on the lower back for tilting movement relative to and independently of the lower back about a second horizontal, transverse axis spaced a substantial distance above the first axis and yieldably restrained against such backward tilting. The axis about which the lower back tilts is located a substantial distance above the seat at a location corresponding to about the middle of the back of an adult human sitting in the chair.

22 Claims, 18 Drawing Figures

ARTICULATED DOUBLE BACK FOR CHAIRS

BACKGROUND OF THE INVENTION

This is a continuation-in-part of U.S. patent application Ser. No. 795,108 filed May 9, 1977, now abandoned, for "Articulated Double Back for Chairs."

The present inventor has heretofore invented chairs having seats that automatically slide backward and forward and backs that tilt backward independently of movements of the seat, such inventions being described and shown in U.S. Pat. No. 3,982,785 granted Sept. 28, 1976, for "Chair," and U.S. Pat. No. 4,084,850 granted Apr. 18, 1978, for "Chair." Those chairs automatically adjust in configuration by sliding of the seat and tilting of the back to support the sitter anatomically in various postures between sitting upright and relaxing backward.

Various chairs, some of which have only been proposed and others of which have been commercialized, have included contoured backs consisting of upper and lower portions that intersect at an angle, but such chairs have, as far as is known, involved upper and lower angularly related portions that are fixed and unadjustable, or are adjustable to fixed configurations, and they are, therefore, comfortable in only a single sitting posture.

Persons who spend long hours sitting, as many office workers do, frequently change their sitting position, because sitting in a single position for long periods of time is tiring and indeed may become painful because fatigue and, on occassion, impairment of blood circulation, compel shifting position from time to time. Although the chairs of the prior patent and application referred to above contribute greatly to improved comfort in a variety of sitting postures, the upper ends of the backs of those chairs are relatively low and do not support the upper parts of the back of persons sitting in them.

SUMMARY OF THE INVENTION

There is provided, in accordance with the present invention, a chair having a back that is somewhat higher than the backs of the chairs of the prior patents referred to above and which, therefore, provides more support for the upper part of the back of a person sitting in the chair. More importantly, the chair back, according to the present invention, is constructed in two parts, both of which articulate relative to a back-supporting frame member of a chair and the upper part of which is mounted on the lower part for articulation. The lower back is mounted on the frame member for backward tilting about a first horizontal, transverse axis, the mechanism by which the lower back is mounted on the frame member being constructed to yieldably restrain the seat in a relatively upright position against such backward tilting. The upper back is mounted on the lower back for backward tilting about a horizontal, transverse axis spaced a substantial distance above the axis about which the lower back tilts and also includes a mechanism that yieldably restrains the upper back in a relatively upright position in which the upper back is inclined slightly forward at an angle relative to the lower back.

A chair back, in accordance with the present invention, provides comfortable support in various sitting postures between an upright sitting position, in which the upper part of the backbone of the person sitting in the chair curves slightly forward relative to the lower portion, and a leaning back position in which the backbone tends to arch back. To this end, the axis about the lower back tilts is located substantially above the seat at a location corresponding to about the middle of the back of an adult human sitting in the chair. The lower back is vertically and transversely co-extensive with the major portion of the middle part of the back of an adult human, and the upper back is vertically and transversely co-extensive with the major portion of the upper part of the back of an adult human in the region where the spine curves forward when such human is sitting upright and straightens when such human arches his back backward. In the latter case, the upper back tilts rearwardly, relative to the lower back, and both the upper back and lower back tilt rearwardly, relative to the back-supporting frame member, as a unit. A chair having the articulated double back of the present invention should also have a seat that slides forward and backward, inasmuch as conformity of the chair configuration to the anatomical posture of the person sitting in it should involve movements of both the seat and back.

In a preferred embodiment, the mechanisms for mounting the lower back on the back-supporting member of the frame and for mounting the upper back on the lower back are substantially identical articulating resilient coupling assemblies, each of which has an upper part and a lower part connected to each other for articulation. The upper part of the frame member is hollow and receives telescopically the lower member of the coupling assembly and the lower back has a downwardly opening socket which receives the upper member of the coupling assembly. Similarly, the lower back has an upwardly opening socket receiving the lower part of the upper coupling assembly, and the upper back has a downwardly open socket receiving the upper part. The parts of the coupling assembly between the upper and lower back are enclosed within a flexible tube which extends and contracts in conformity with relative movements of the upper and lower back.

A desirable, though not essential, feature of a chair back, according to the invention, is the mounting of the lower back and upper back on the back support for vertical adjustment as a unit, thus to permit the height of the back relative to the seat to be adjusted to suit the user.

Although various resilient articulating linkages may be used effectively to mount the lower back on the frame and the upper back on the lower back, another aspect of the present invention involves a particularly effective coupling assembly which is useful not only in articulating double backs embodying the invention but in chairs of the type to which the patents referred to above relate. The coupling assembly comprises a first part joined to the back-supporting member, a second part joined to the chair back, an axle joining the two parts for pivotal movement relative to each other and a spring reaction plate mounted on the axle. Each of the aforementioned parts and the reaction plate have spaced-apart surfaces facing each other, and compression springs are engaged between the facing surface of each part and the corresponding facing surface of the reaction plate. The springs yieldably restrain the parts in a first predetermined position with stop surfaces associated with the parts and the reaction plate in engagement. Upon compression of the springs under a force tending to tilt the back backward, the parts articulate about the axle to a limit backward-tilted position established by engagement of stop surfaces on the parts and the reaction plate. The compression springs are, preferably, blocks of an elastomeric material, such as polyurethane. The above-described coupling assembly is of relatively simple construction, highly durable, and quiet in operation.

DESCRIPTION OF EMBODIMENTS

Figure 1:
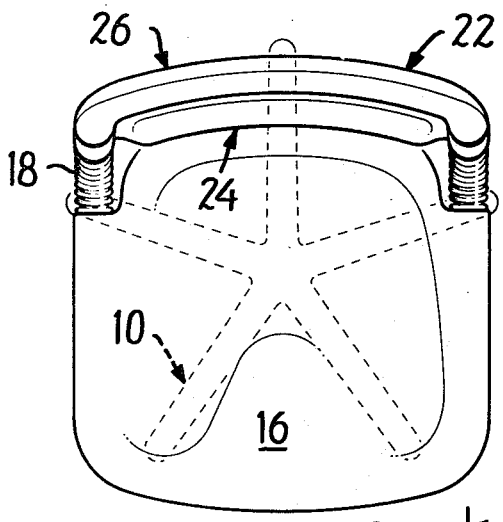
FIGS. 1 through 5 are top, front, bottom, back and side views, respectively, of one embodiment of a chair having the articulated double back according to the present invention.
Figure 4:
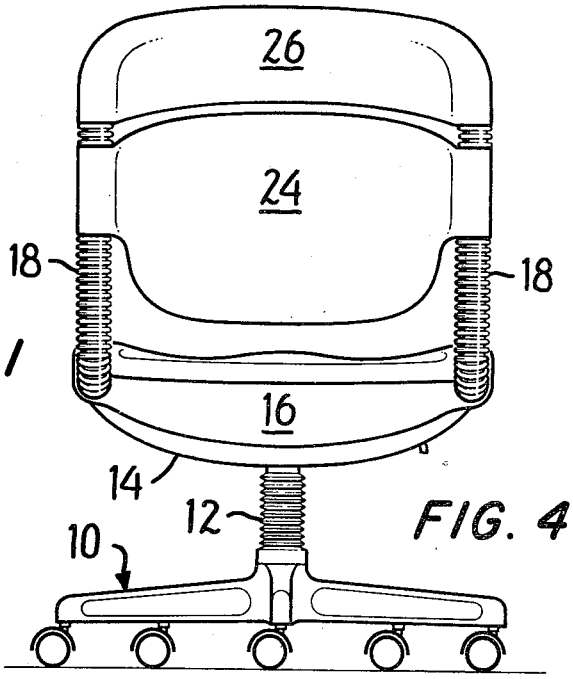
Figure 2:
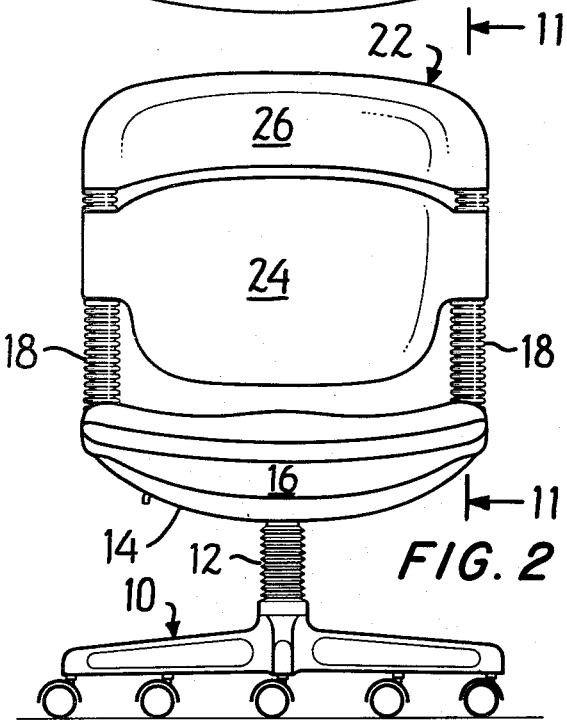
Figure 5:
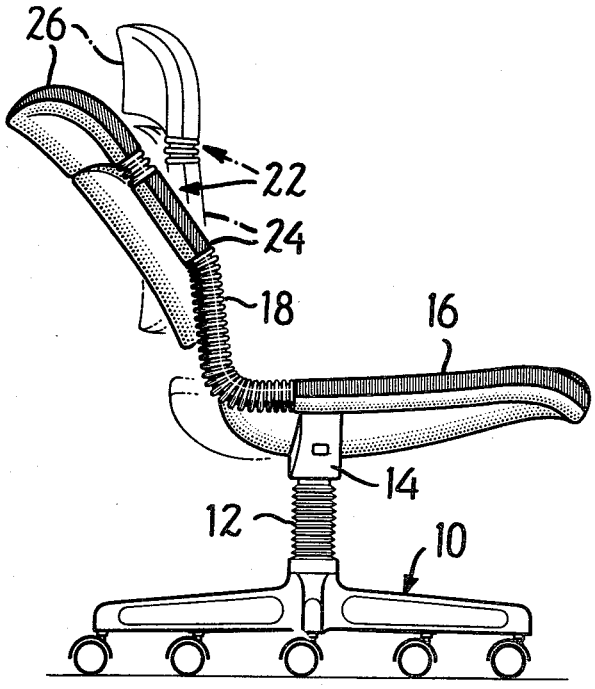
Figure 3:
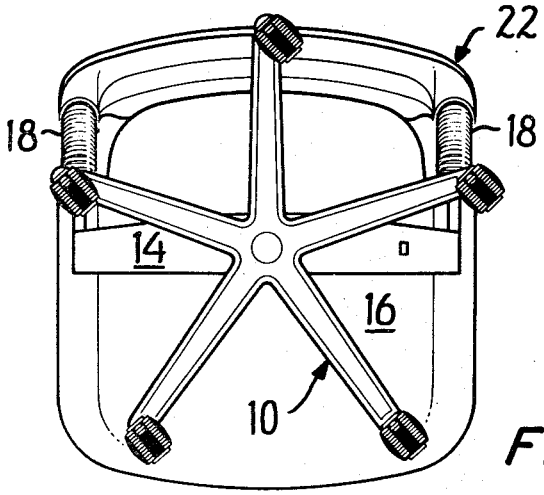
Figure 6:
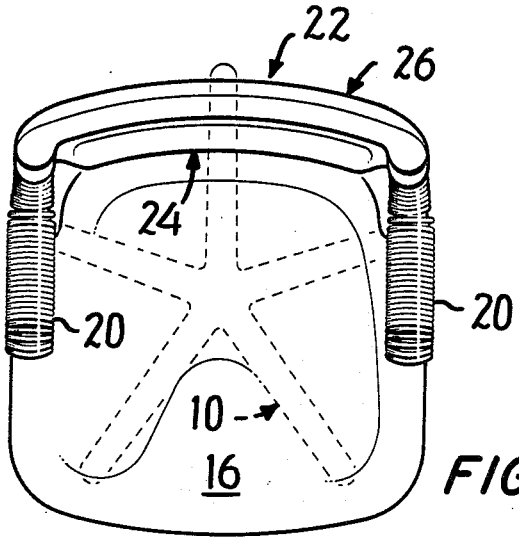
FIGS. 6 through 10 are top, front, bottom, back and side views, respectively, of another chair having the articulated double back.
Figure 9:
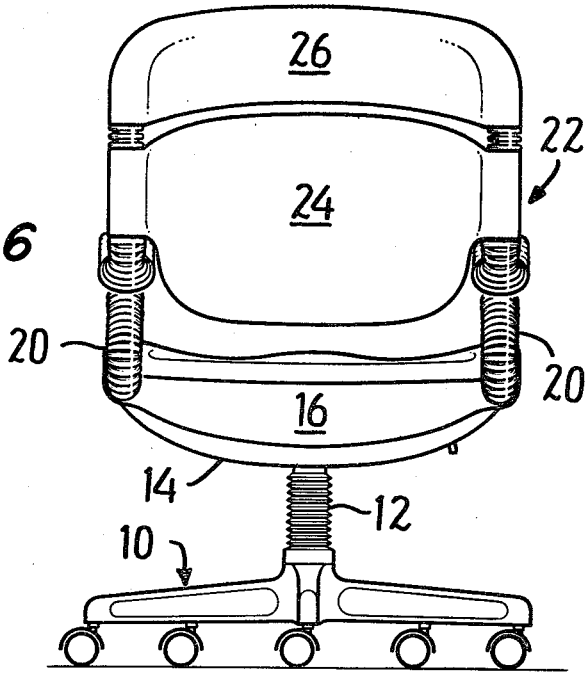
Figure 7:
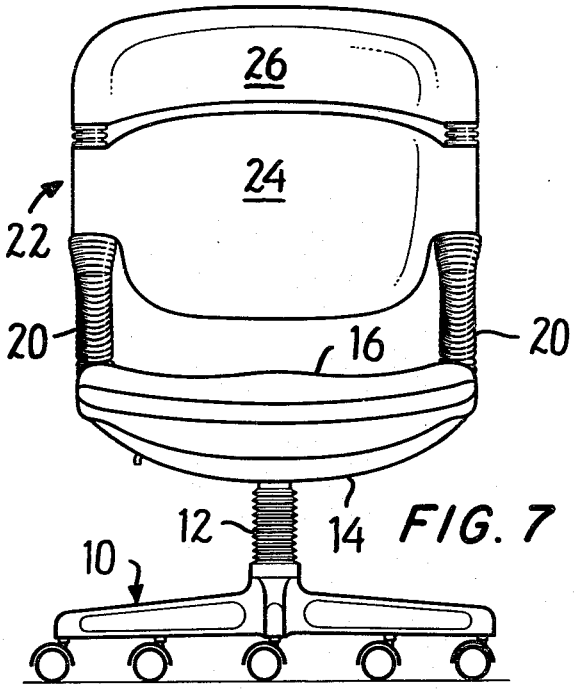
Figure 10:
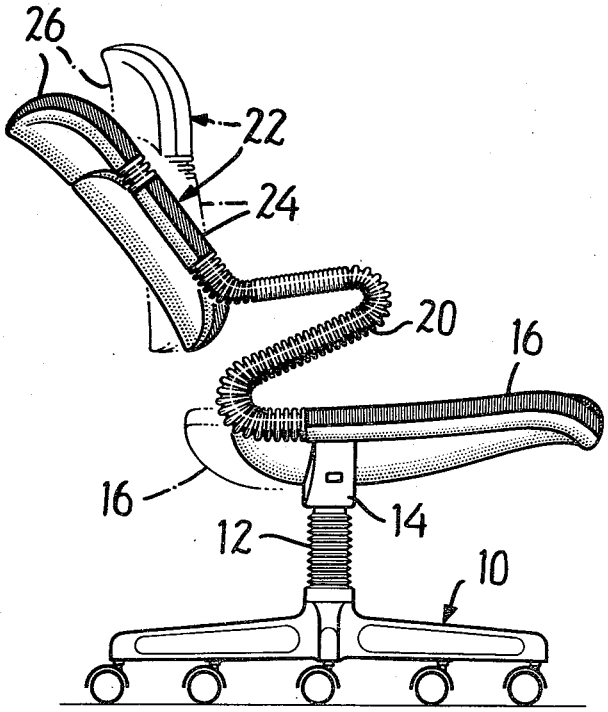
Figure 8:
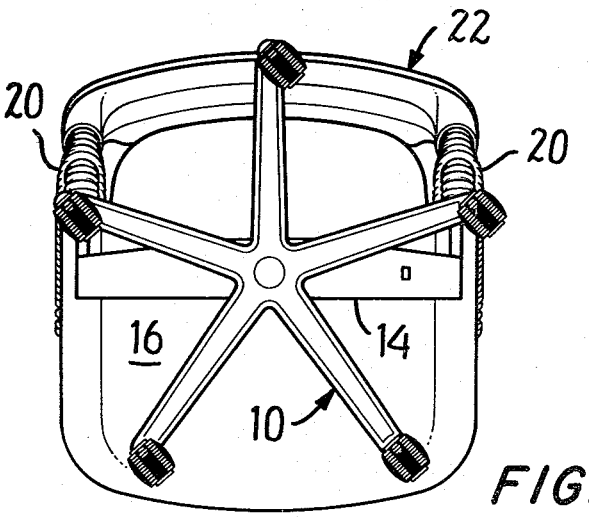

The two chairs shown in FIGS. 1 to 10 of the drawings are the same except that the chair shown in FIGS. 1 to 5 does not have arms, while the chair shown in FIGS. 6 to 10 has arms that are parts of the seat supports and back supports. Both of the chairs have a caster base 10 having a post 12, a transverse beam-like member 14 located under the seat and mounted on the post 12 and a seat 16 that is mounted to slide backward and forward on a pair of spaced-apart seat supporting members of the chair frame, which members are not visible in the drawings. The arrangement by which the seats of the two chairs are mounted on the frame members for backward and forward movement is essentially the same as the arrangement described and shown in the specification and drawings of U.S. Pat. No. 4,084,850 referred to above (see FIGS. 5A and 5B and the corresponding description). The chair shown in FIGS. 1 to 5 includes an L-shaped metal tubular frame member at each side, the lower horizontal leg of each of which is a seat supporting member and the upper, generally vertical leg of each of which is a back supporting member. The exposed parts of the tubular metal frame members are enclosed within flexible, extensible sleeves 18 (also as described in U.S. Pat. No. 4,084,850). The only difference between the chair shown in FIGS. 6 to 10 and the chair shown in FIGS. 1 to 5 involves the substitution of generally S-shaped tubular frame members (concealed within similarly shaped flexible, extensible converings 20) in the chair of FIGS. 6 and 10 for the L-shaped frame members in the chair of FIGS. 1 to 5. Although the construction of the chairs of FIGS. 1 to 10 of the drawings, as described up to this point, forms no part of the present invention and is the subject matter of the aforementioned U.S. Pat. No. 4,084,850, the present invention is used to best advantage in chairs that have a seat that slides backward and forward, notably the chairs described and shown in the prior patents of the present inventor referred to above.

The backs 22 of both of the chairs shown in FIGS. 1 to 10 are identical and are articulated double backs constructed in accordance with the present invention. The articulated double back 22 consists of a lower back 24 and an upper back 26. Both the lower and upper back are preferably molded from a suitable high-impact strength plastic and are contoured vertically and horizontally to provide comfort to the back of a person sitting in the chair. Both the lower and upper backs may be padded and upholstered, and each may also be constructed in metal by molding or stamping. The details of the shape, material and finish of the upper and lower backs are susceptible of numerous variations and modifications.

The lower back 24 is mounted on the upper ends of the tubular side frame members that are enclosed within the extensible covers 18 or 20, as the case may be. More particularly, the upper ends 27 of the side frame members of the chairs receive parts of a pair of identical articulating resilient coupling assemblies 28 (see FIGS. 11 and 12), and the upper back 26 is mounted on the lower back by another pair of coupling assemblies 30. Parts of the assemblies 28 and 30 are received within sleeves 32 formed along the sides of the lower back 24, and parts of the upper assemblies 30 are received within sleeves 34 formed along the sides of the upper back 26. The lower coupling assemblies 28 are identical to the upper coupling assemblies 30, the upper assemblies 30, however, being installed in an inverted position as compared to the lower assemblies 28. Moreover, the coupling assemblies 28 and 30 are substantially the same as coupling assemblies shown in FIGS. 18 and 19 of U.S. Pat. No. 4,084,850 (referred to above) and described in the specification of that application.

Each coupling assembly 28 or 30 includes a tubular casing 36 which receives in one end an annular retainer 38 having at its free end an annular rib 40, the retainer 38 being fastened, such as by crimping, in the casing 36. A connecting rod 42 extends through the casing 36 and retains one end of a compression spring 44 by way of a retainer ring 46 backed up by a washer 48 and a pair of nuts 50. The other end of the compression spring 44 engages the inner end of the retainer 38. The other end of the connecting rod 42 has a hemispherical head 52 which is engaged by a seat 54 on another retainer 56 which is fastened, such as by rivets 58 to the upper end 27 of the side frame members, in the case of each lower coupling assembly 28, and to a tubular extension piece 60 received within the sleeve 34 of the upper back 26, in the case of each upper assembly 30. The annular rib 40 of the retainer 38 mates with an annular groove 62 in the second retainer 56. An annular cushion 63 is installed on a seat adjacent the rib 40 on the retainer 38.

Figure 11:
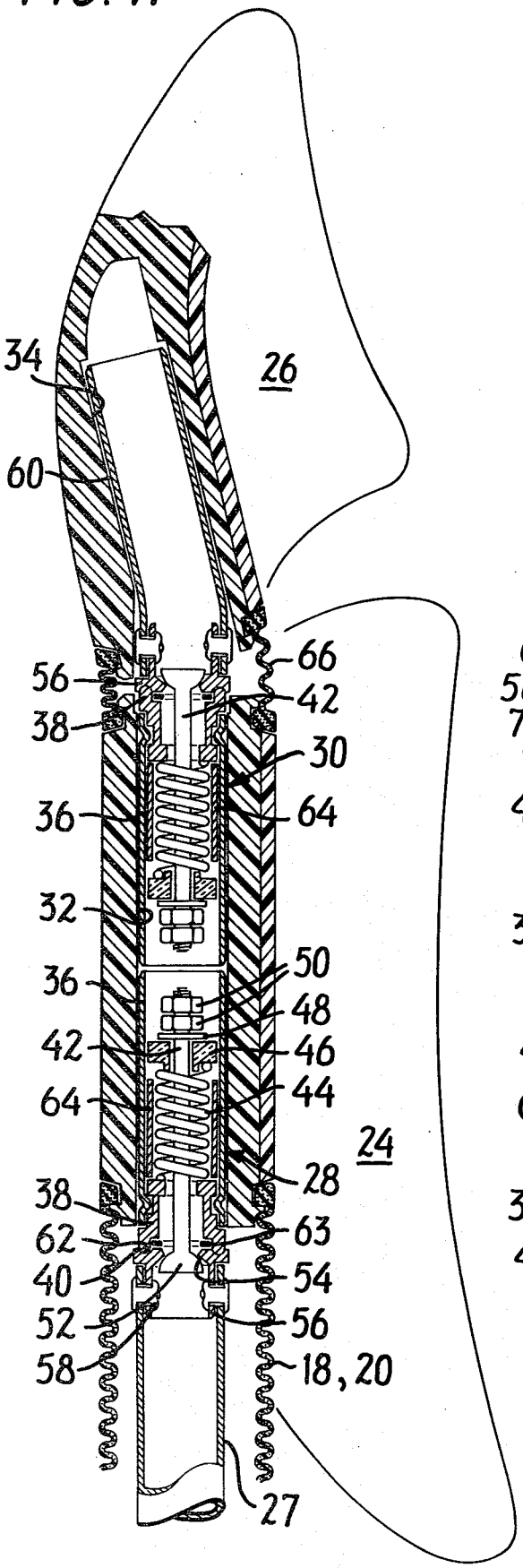
FIG. 11 is a side view in cross section of the double articulating back of both of the chairs of FIGS. 1 through 10, the section being taken generally along the plane designated by lines 11—11 in FIGS. 2 and 7 and in the direction of the arrows, the lower back and upper back being shown in their upright, restrained positions.

The spring 44 of each coupling assembly 28 and 30 is preloaded and yieldably draws the retainer rings 38 and 56 into engagement with the rib 40 seated in the mating groove 62, as shown in FIG. 11. Thus, in the absence of an application of forces to the upper back 26 or lower back 24 sufficient to overcome the preloaded forces in the springs, the articulated double back will be yieldably restrained in the position shown in FIG. 11.

Figure 12:
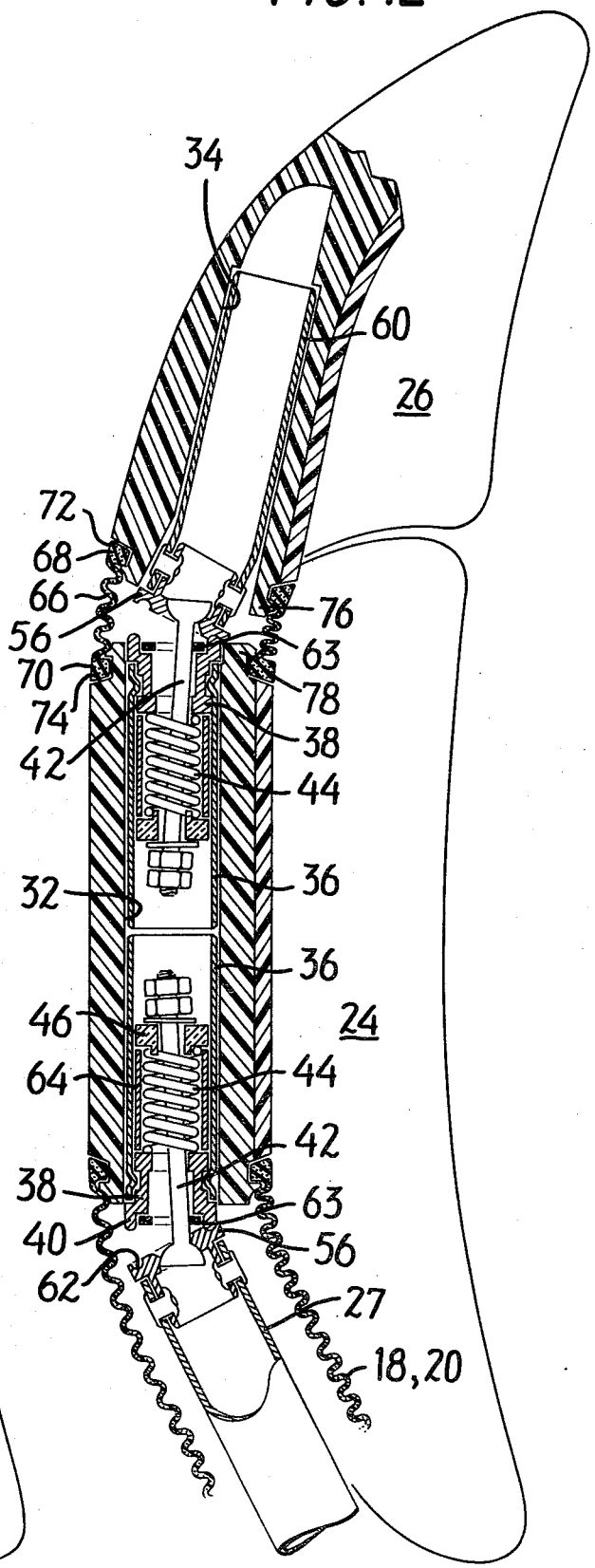
FIG. 12 is a side view in cross section of the chair back taken along the same plane as FIG. 11 but showing the upper and lower backs tilted to their rearwardmost limit positions.

A force applied to the front of the lower back 24 by the back of a person sitting in the chair who leans back in the chair will, if of a sufficient magnitude to overcome the forces in the compression springs 44 of the lower coupling assemblies 28, automatically "break" the assemblies 28 in that the retainer 38 and all parts associated with it, including the lower back 24, will pivot about the rear portion of the rib 40 of the retainer 38 (see FIG. 12). Thus, the lower back 24 will tilt backward relative to the frame members. The extent of backward tilting is limited by a spacer sleeve 64 which limits the extent of movement of the spring retainer ring 46 relative to the retainer 38 as the retainer 38 rocks away from the retainer 56. Articulation of the lower back 24 relative to the chair frame takes place automatically whenever the person sitting in the chair leans back to assume a relaxed posture. The spring forces in the lower coupling assemblies 28 are, however, sufficient to provide firm support for the back of the person when he sits upright and leans back without trying to slump into a relatively relaxed, leaning-back posture. The lower coupling assemblies 28 will automatically restore the back to an upright position when the person resumes an upright posture.

When the person sitting in the chair relaxes quite far back and arches his back, the upper part of his back will apply a force to the upper back 26, which will cause the upper coupling assemblies to "break" in the same manner as the lower assemblies and as depicted in FIG. 12. Removal of a backward force on the upper back 26 will permit the upper assemblies 30 to restore the upper back to the upright position, as shown in FIG. 11. Forcing the upper back of the chair to tilt backward tenses the muscles in the neck and back, and releasing that tension when returning to a normal position distends the muscles and has a soothing effect. The annular cushion 63 in all of the coupling assemblies quiets and absorbs any shock of an abrupt restoration of the lower back 24 or upper back 26 to the upright positions of FIG. 11.

In the same manner as described in U.S. Pat. No. 4,084,850 referred to above, the extensible, flexible sleeve 18 or 20 covering each of the side frame members of the chair extends and retracts in accordance with the articulation of the lower back 24 relative to the back-supporting frame members. An extensible, flexible covering 66 encloses the parts of the upper coupling assemblies 30 between the sleeves 32 of the lower back 24 and the sleeves 34 of the upper back 26. The ends of the coverings 66 have flanges 68 and 70 which are received in grooves 72 and 74 on annular flanges 76 and 78 surrounding the openings of the sleeves 34 and 32.

The profiles of the upper edge of the lower back and the lower edge of the upper back are of substantially complementary shapes, and the transverse contours of the front surfaces of the upper and lower backs are contiguous. The vertical contours of the upper back intersect corresponding contours of the lower back at an angle, the upper back being more upright than the lower back in the normal upright position. As described above, articulation occurs in two stages, depending on the posture assumed by the person sitting in the chair. The first stage involves backward tilting of the lower and upper backs as a unit when the person leans back to relax in the chair but does not arch backward. The second stage, tilting of the upper back relative to the lower back, occurs when the person arches his or her back, thus straightening the upper part of his or her spine and "breaking" the upper articulating coupling.

Figure 13:
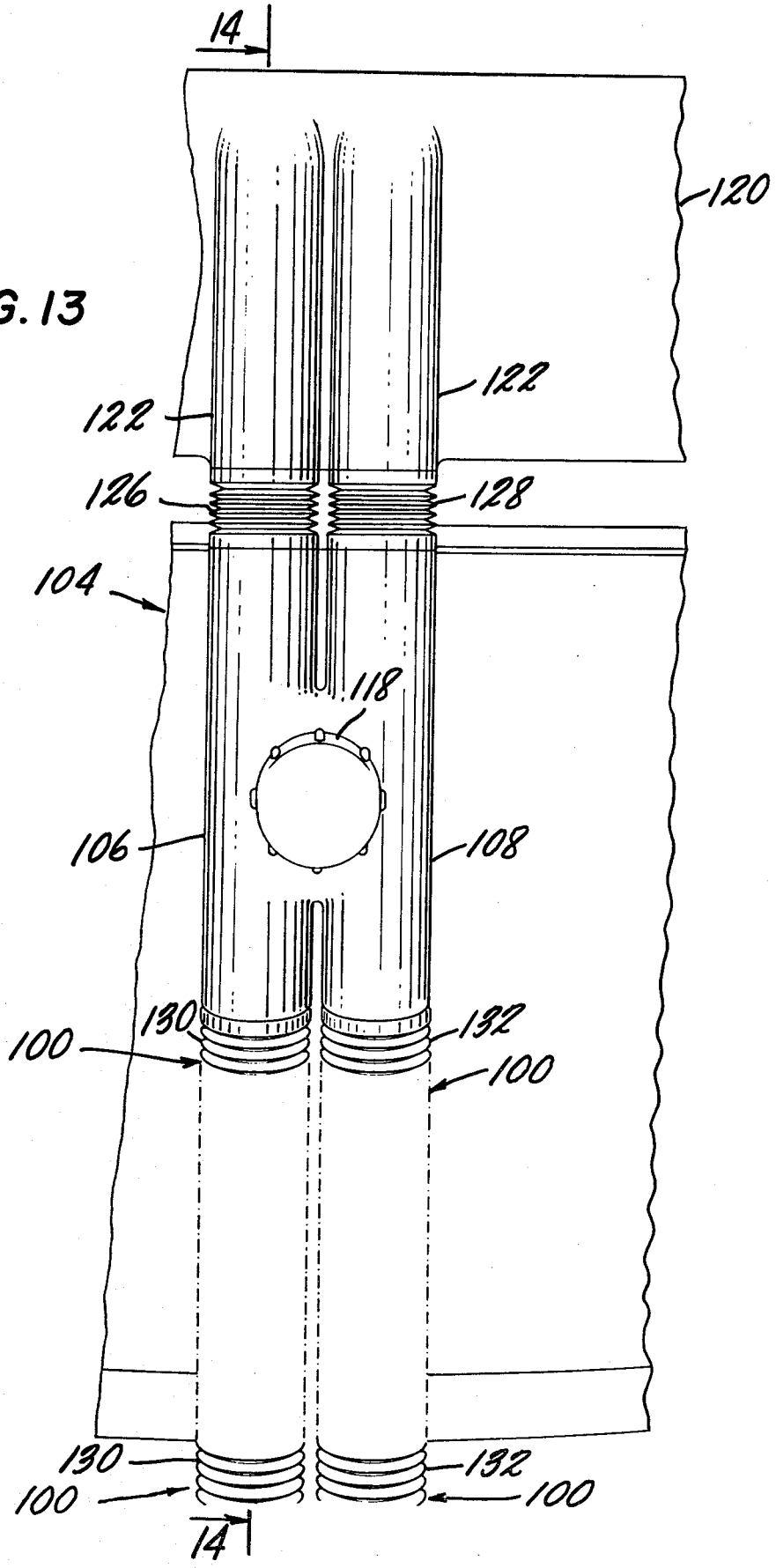
FIG. 13 is a partial rear elevational view of another chair back embodying the invention.
Figure 14:
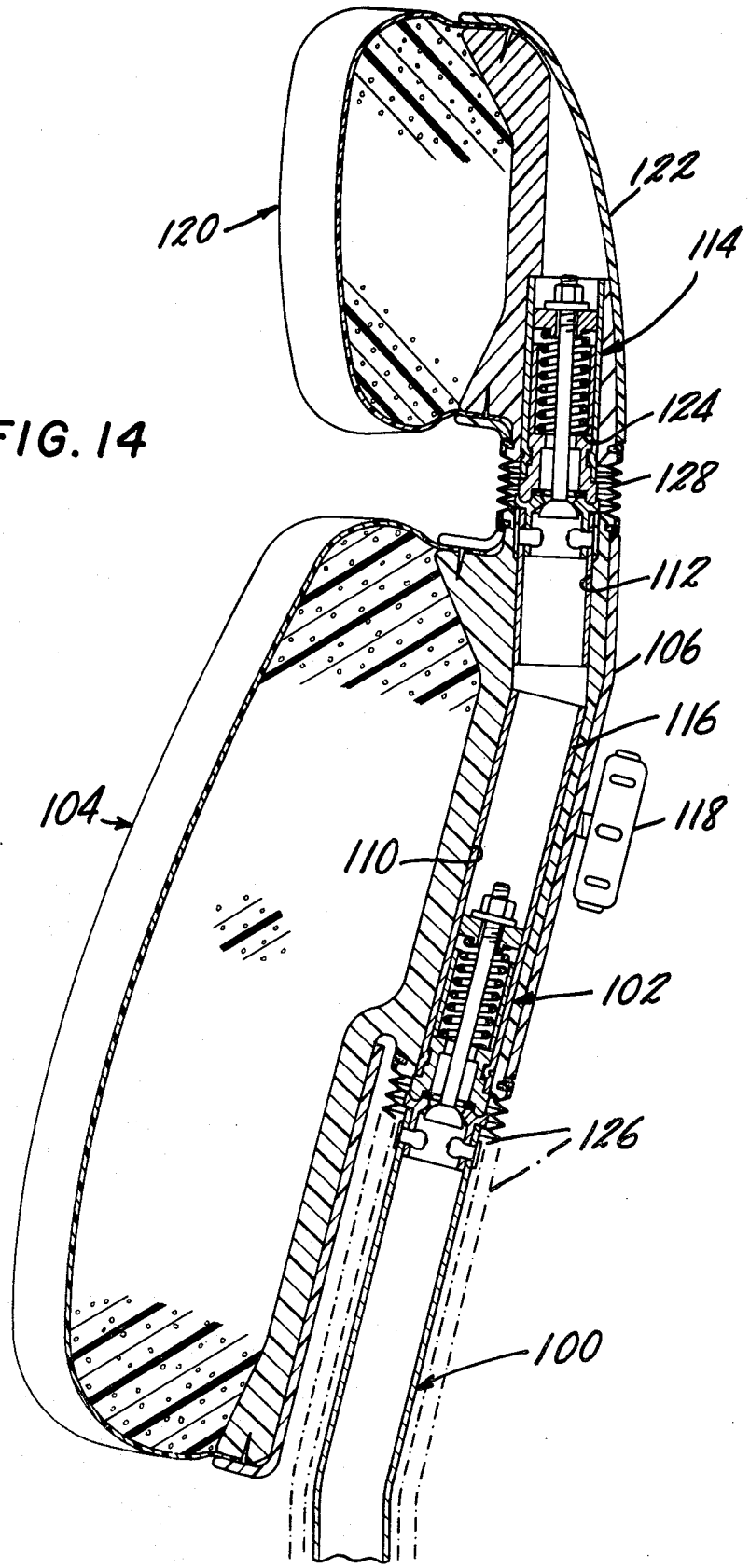
FIG. 14 is a side view in cross section of the chair back of FIG. 13 shown in the upright position, the section being taken along the lines 14—14 of FIG. 13 and in the direction of the arrows.
Figure 15:
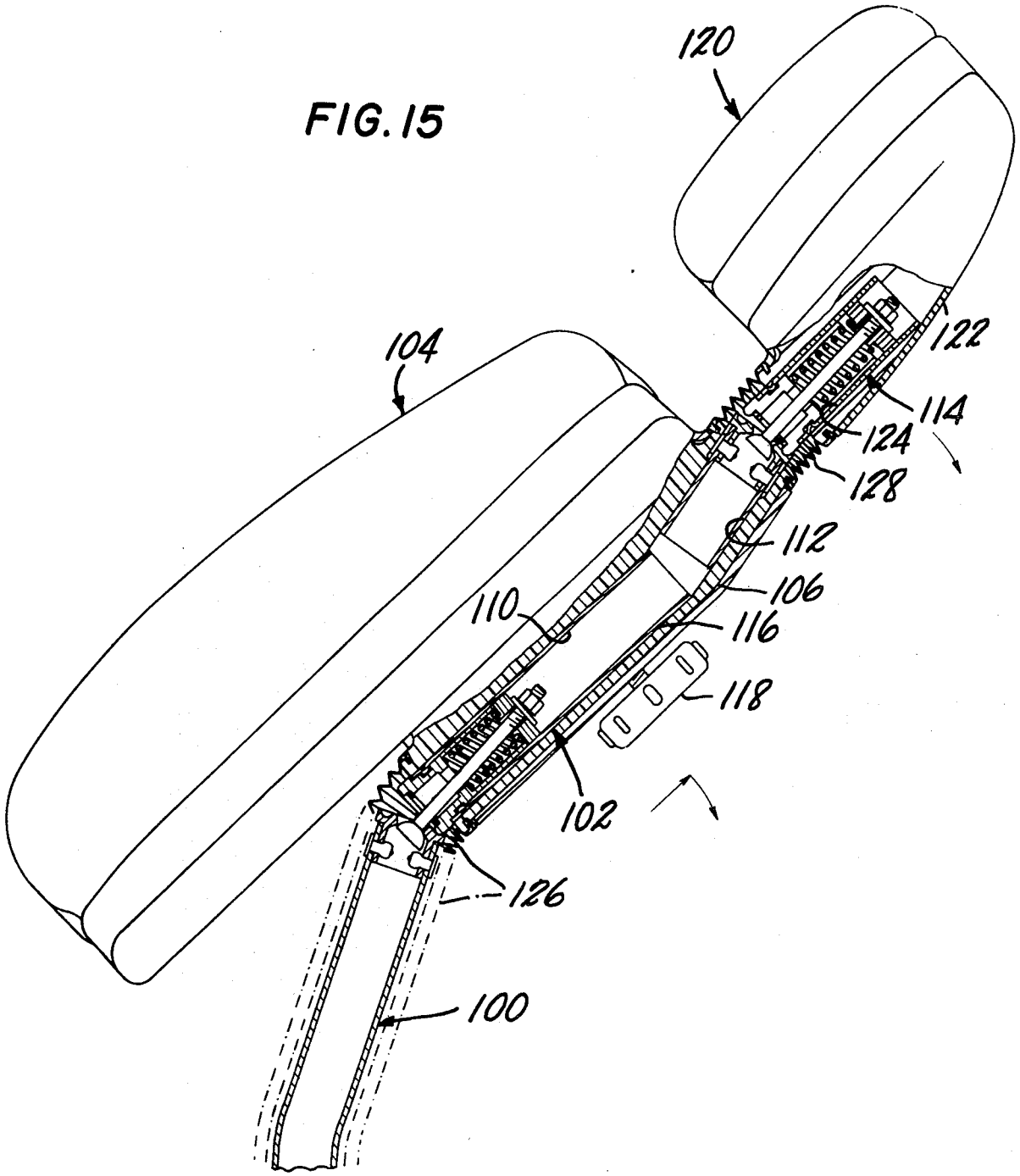
FIG. 15 is a side cross-sectional view of the chair back of FIGS. 13 and 14 and showing the lower back tilted backward about the lower axis and the upper back tilted backward about the upper axis.

The embodiment shown in FIGS. 13 to 15 is similar in many respects to those of FIGS. 1 to 12. The principal differences are, first, the provision of a centrally located back support structure, the articulating couplings being correspondingly located in generally the lateral center of the double back, and, second, provision for adjusting the height of the double back assembly as a unit relative to the seat.

The chair frame includes a pair of closely spaced, centrally located back support members 100 in the form of steel tubes suitably joined rigidly to other parts of the frame, such as by connection to the seat supporting structure. The upper end of each back support tube receives the lower part of a lower resilient articulating coupling assembly 102. The four (two lower and two upper) coupling assemblies of the chair of FIGS. 13 to 15 are identical to each other except in one respect and, in all material respects are the same as the coupling assemblies of the embodiments of FIGS. 1 to 10. The description above of the coupling assemblies and how they work is applicable to the coupling assemblies of the double back of FIGS. 13 and 15 and need not be repeated.

The rear face of the lower back 104 includes a pair of vertical hollow bosses 106 and 108 (see FIG. 13) extending the full height on either side of the vertical center line, except that they merge near the vertical center, as may be seen in FIG. 13. Each boss 106 or 108 defines an elongated downwardly opening lower socket 110 in which the upper part of the lower coupling assembly 102 is received and an upwardly open upper socket 112 in which the lower part of an upper resilient articulating assembly 114 is received and secured.

By comparing FIGS. 11 and 12 with FIGS. 14 and 15, the following differences between the two versions will be discerned. First, the upper tubular parts of the lower coupling assemblies 102 of the embodiment of FIGS. 14 and 15 are much longer; second, the upper assemblies 114 are inverted (to leave room for the long upper tubular parts 116 of the lower assemblies 102 in the sockets for a reason that will soon become apparent; third, the lower back is not fastened to the upper parts 116 of the lower coupling assemblies 102; fourth, a lock screw 118 with a large hand knob passes through a threaded metal sleeve (not shown) in the common center part of the bosses 106 and 108 and works against a lock shoe (also not shown) that selectively engages the upper parts 116 of the lower coupling assemblies. When the lock screw is loosened, the lower back 104 and the upper back 102 can be slided as a unit up or down on the part 116 (within, of course, the limits of adjustment) to suit the person who uses the chair and locked at the desired height above the seat by retightening the lock screw. This is a desirable, though not essential, feature, and while it has been used in some types of seating, especially secretarial chairs, is believed to be unique as applied to a chair back shaped vertically to match the spine and constructed to adjust automatically to changes in the shape of the spine when the person sitting in the chair changes his or her sitting posture.

The upper back 120 is mounted on the lower back in a resiliently restrained position more upright than the lower back in much the same way as in the embodiments of FIGS. 1 to 10. Bosses 122 on the rear wall of the upper back define downwardly open sockets 124 which receive the upper parts of the upper resilient articulating assemblies 114. Flexible, extensible, bellows-like tubes 126 and 128 that deform as the assemblies articulate conceal and protect the parts of the double back at the junctures between the upper back and lower back. Similar extensible tubes 130 and 132 cover the exposed parts of the lower coupling assemblies, extend or retract to accommodate vertical adjustment of the back and ornament the back frame members.

Figure 16:
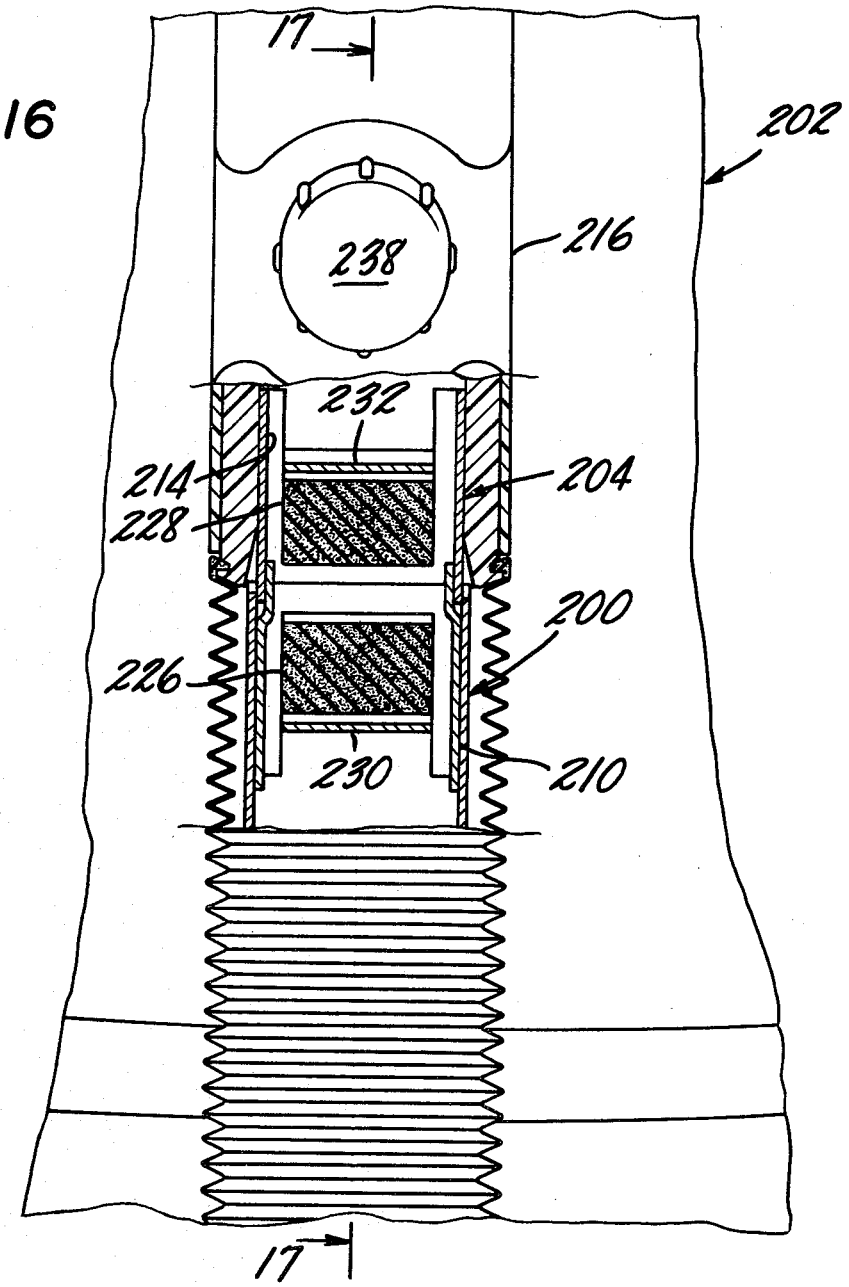
FIG. 16 is a partial rear view of another embodiment, a portion being broken away in section along lines 16—16 of FIG. 17 to show one of the resilient articulate coupling assemblies.
Figure 17:
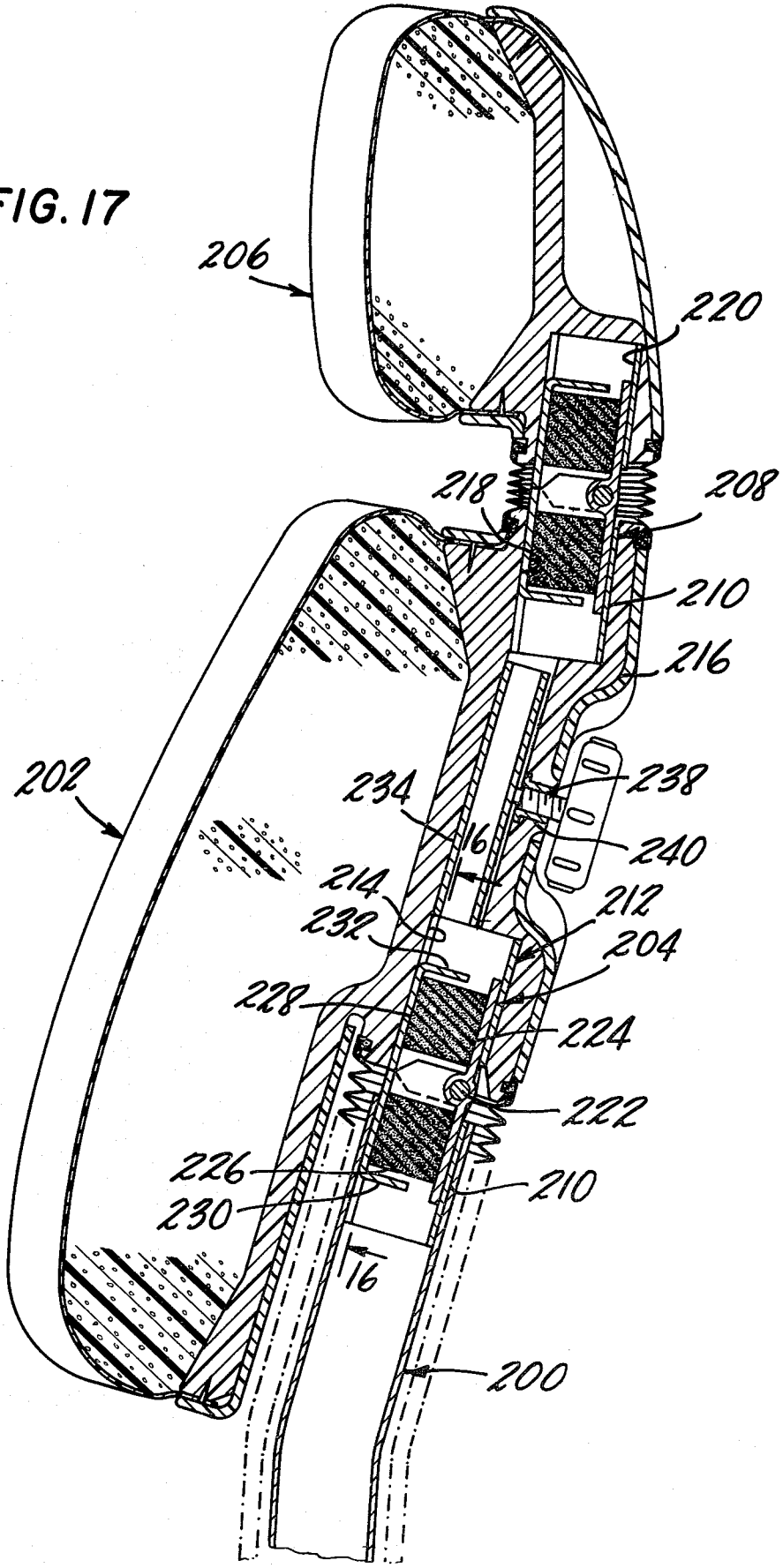
FIG. 17 is a side view in cross section of the embodiment of FIG. 16 taken along the lines 17—17 of FIG. 16 and in the direction of the arrows, the double articulating back being shown in its upright, resiliently restrained position.
Figure 18:
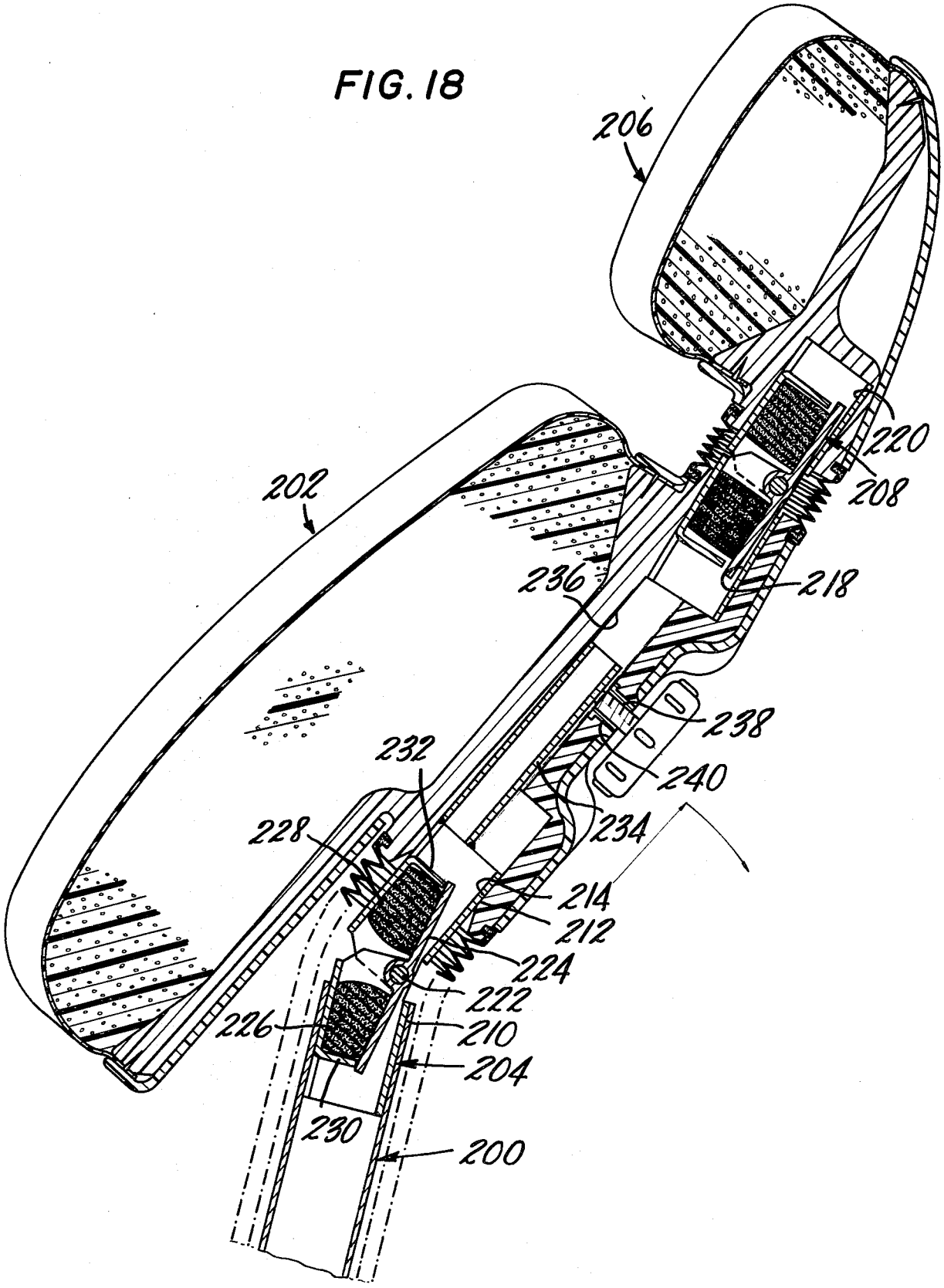
FIG. 18 is a side cross-sectional view similar to FIG. 17 except that the lower and upper backs are tilted backward as a unit about the lower axis.

The embodiment of the articulated double back for chairs shown in FIGS. 16 to 18 includes a single, centrally-located back-supporting frame member 200 which is tubular and of generally rectangular cross section and is suitably joined to some other part of the chair frame. The lower back 202 is mounted for backward tilting on the upper end of the frame member 200 by a resilient articulating coupling assembly 204, and the upper back 206 is mounted for rearward tilting relative to the lower back by a second resilient articulating coupling assembly 208. As is the case with the embodiment of FIGS. 1 to 12, the two coupling assemblies 204 and 208 are identical in structure, with one exception that is discussed below. Each coupling assembly includes a tubular lower part 210 and a tubular upper part 212, each of which is shaped in cross section to be received telescopically in sockets in the respective members which the assembly connects. Specifically, the lower part 210 of the lower assembly 204 is received in the upper end of the back support 200; the upper part 212 of the lower assembly is received within a socket 214 formed by a boss 216 which projects from the rear face of the lower back 202; the lower part 210 of the upper assembly is received in an upwardly open socket 218 in the upper end of the boss 216; and the upper part 212 of the upper assembly is received in a downwardly open socket 220 formed in a centrally-located boss on the upper back 206.

The upper ends of the side walls of the lower part 210 of each coupling assembly overlap the lower ends of the side walls of the upper part 212, the upper portions of the side walls of the lower part being deformed inwardly to fit within the upper portions of the side walls of the lower part 210. The overlapping of the side walls permits the two parts 210 and 212 to be connected by a pin or axle 222 for articulation. A spring reaction plate 224 mounted on the axle 22 engages one end of each of two compression springs 226 and 228 in the form of blocks of an elastomeric material such as a relatively high durometer polyurethane. The other end of each elastomeric spring engages the front wall of the corresponding lower or upper part 210 or 212 of the coupling assembly. A piece at the lower end of the front wall of the lower part 210 is slit and bent inwardly to form a lug or tab 230, and a similar tab 232 is created in the front wall of the upper part 212.

By comparing FIGS. 17 and 18, it will be seen that the compression springs 226 and 228 yieldably restrain the two parts 210 and 212 of the coupling assemblies in a predetermined position established by engagement between the back face of the spring reaction plate 224 and the rear walls of the tubular parts 210 and 212 with a force determined by the preloading of the springs. When the spring forces are exceeded, the coupling assembly "breaks" by pivoting of the upper and lower parts 212 and 210 about the axle 222. The spring forces balance out between the two springs 226 and 228 automatically, inasmuch as both the upper and lower parts are free to pivot about the axle. The limit or stop position of rearward tilting of the lower back relative to the back support is established by engagement by the lugs 230 and 232 in the front walls of the tubular parts 210 and 212 with the spring reaction plate (see FIG. 18).

In a manner similar to that described above, the upper coupling assembly 208 normally restrains the upper back in a predetermined position relative to the lower back but "breaks" when the spring forces are exceeded to an extent determined by engagement between the lugs and the spring reaction plate.

The height adjustment feature of the embodiment of FIGS. 13 to 15 is also provided in the embodiment of FIGS. 16 to 18. A tubular extension 234 is welded or otherwise joined to the upper tubular part 212 of the lower coupling assembly 204 and extends up into a socket 236 in the lower back 202. A lock screw 238 threaded into a threaded sleeve 240 installed in the boss 216 clamps the lower back 202 at a selected adjusted height (within the limits of adjustment) above the seat. The extensible bellows-like tubes are provided in this embodiment as in the other embodiments.

I claim:

1. A chair back comprising at least one back-supporting frame member, a lower back, means mounting the lower back on the frame member for backward tilting movement about a first horizontal, transverse axis and for yieldably restraining such backward tilting, the first axis being located substantially above the seat at a location corresponding to about the middle of the anatomical back of an adult human sitting in the chair, an upper back, and means mounting the upper back on the lower back for backward tilting movement of the upper back relative to and independently of the lower back about a second horizontal, transverse axis located substantially above the first horizontal axis and for yieldably restraining such backward tilting, the lower back being vertically and transversely co-extensive with the major portion of the middle part of the anatomical back of an adult human, and the upper back being verticallly and transversely co-extensive with the major portion of the upper part of the anatomical back of an adult human in the region where the spine curves forward when such human is sitting upright and straightens when such human arches backward.

2. A chair according to claim 1, wherein the means mounting the lower back and the means mounting the upper back include substantially identical articulating resilient coupling assemblies, each of which assemblies has an upper part and a lower part connected to each other for articulation.

3. A chair according to claim 2, wherein the frame member includes a hollow upper portion receiving telescopically the lower member of a coupling assembly and the lower back has a downwardly opening socket receiving the upper member of the coupling assembly.

4. A chair according to claim 2, wherein the lower back has an upwardly open socket receiving the lower end of a coupling assembly and the upper back has a downwardly open socket receiving the upper end of the coupling assembly.

5. A chair according to claim 4, wherein the sockets on the lower and upper backs are spaced apart and wherein the parts of the coupling assembly between the sockets are enclosed within a flexible, extensible tube.

6. A chair according to claim 2, wherein each coupling assembly includes means establishing and maintaining a given position of the upper part relative to the lower part in the absence of application of a predetermined force to the upper part and for yielding to a force imposed on the upper part that is greater than such predetermined force.

7. A chair according to claim 1, wherein there is a back-supporting frame member located adjacent each side of the chair and wherein the means mounting the lower back on the frame member includes a resilient articulating coupling assembly associated with each frame member.

8. A chair according to claim 7, wherein the means mounting the upper back on the lower back includes a resilient articulating coupling assembly adjacent each side of the chair back.

9. A chair according to claim 1, wherein the profiles of the upper edge of the lower back and the lower edge of the upper back are substantially complementary and the front surfaces of the upper and lower backs intersect at an angle with the front surface of the upper back being more upright than the front surface of the lower back when the upper back is in its upright, restrained position relative to the lower back.

10. A chair according to claim 1, wherein in its restrained position the upper back is inclined forwardly relative to the lower back.

11. A chair according to claim 1, wherein the means mounting the lower back on the frame member includes means affording vertical movement of the lower back relative to the back-supporting frame member and for releasably locking the lower back in a selected position relative to the frame member.

12. A chair according to claim 1, wherein the means mounting the lower back on the frame member includes first stop means engageable to establish the restrained position of the lower back and second stop means engageable to limit the extent of backward tilting movement of the lower back about the first axis.

13. A chair according to claim 1, wherein the means mounting the upper back on the lower back includes first stop means engageable to establish the restrained position of the upper back and second stop means engageable to limit the extent of backward tilting movement of the upper back about the second axis.

14. A chair according to claim 1, wherein the back-supporting frame member is located in generally the center of the chair.

15. A chair according to claim 1, wherein the means mounting the lower back on the frame member includes a resilient articulating coupling assembly having an upper part and a lower part joined for articulation, means establishing and resiliently maintaining a given position of the upper part relative to the lower part, and stop means for limiting the extent of rearward tilting of the lower back.

16. A chair according to claim 1, wherein the means mounting the lower back on the frame member includes a resilient articulating coupling assembly having a lower part joined to the frame member, an upper part joined to the lower back, an axle joining the upper and lower parts for pivoting about the axis, a spring reaction plate mounting on the axle, the plate and the two parts having spaced-apart surfaces facing each other, and a compression spring positioned between the facing surface of each part and the corresponding facing surface of the reaction plate and yieldably restraining the lower back in the upright position.

17. A chair according to claim 16, wherein the parts and the reaction plate include first stop portions adapted to engage and hold the parts in a position establishing the upright position of the lower back.

18. A chair according to claim 17, wherein the parts and the reaction plate include second stop portions adapted to engage in a selected limit position of backward tilting of the lower back.

19. A chair according to claim 18 wherein the means mounting the upper back on the lower back is substantially identical to the means mounting the lower back on the frame member.

20. In a chair having a back mounted on a back-supporting member to tilt backward from a restrained relatively upright position, an improved resilient articulating coupling assembly comprising a first part joined to the back-supporting member, a second part joined to the back, an axle joining the two parts for pivotal movement relative to each other, a spring reaction plate mounted on the axle, each of the parts and the reaction plate having spaced-apart surfaces facing each other, and a compression spring engaged between the facing surface of each part and the corresponding facing surface of the reaction plate and yieldably restraining the back in a generally upright position.

21. The improvement claimed in claim 20, wherein the parts and the reaction plate include first stop portions adapted to engage each other and hold the parts in a position establishing the upright position of the back.

22. The improvement according to claim 20, wherein the parts and the reaction plate include second stop portions adapted to engage in a selected limit position of backward tilting of the back.

* * * * *